US006643969B1

(12) United States Patent
Avizonis, Jr.

(10) Patent No.: US 6,643,969 B1
(45) Date of Patent: Nov. 11, 2003

(54) OPTICAL SIGHT APPARATUS FOR FIRING FROM COVER POSITIONS

(75) Inventor: Petras V. Avizonis, Jr., Carlsbad, CA (US)

(73) Assignee: Exponent, Inc., Menlo Park, CA (US)

( * ) Notice: Subject to any disclaimer, the term of this patent is extended or adjusted under 35 U.S.C. 154(b) by 0 days.

(21) Appl. No.: 10/235,847

(22) Filed: Sep. 6, 2002

(51) Int. Cl.[7] ..... F41G 1/00
(52) U.S. Cl. ..... 42/118; 42/124
(58) Field of Search ..... 42/118, 148, 120; 359/419, 433, 402–406, 830, 827, 852

(56) References Cited

U.S. PATENT DOCUMENTS

| | | | | | |
|---|---|---|---|---|---|
| 708,720 | A | * | 9/1902 | Konig | 359/402 |
| 880,378 | A | * | 2/1908 | Gies | 356/254 |
| 1,260,285 | A | | 3/1918 | Cordell | |
| 1,290,777 | A | * | 1/1919 | O'Brien | 359/420 |
| 1,951,849 | A | * | 3/1934 | Steinle | 359/402 |
| 3,749,494 | A | * | 7/1973 | Hodges | 356/16 |
| 3,758,198 | A | * | 9/1973 | Kanie et al. | 359/828 |
| 3,863,354 | A | | 2/1975 | Karppinen | 33/233 |
| 3,966,298 | A | * | 6/1976 | Chapman | 359/401 |
| 4,015,905 | A | | 4/1977 | Lloyd | 356/248 |
| 4,084,326 | A | * | 4/1978 | Numbers | 42/122 |
| 4,275,639 | A | | 6/1981 | Garber | 89/41 |
| 4,313,272 | A | | 2/1982 | Matthews | 42/1 |
| 4,582,400 | A | * | 4/1986 | Lough | 313/524 |
| 4,878,305 | A | | 11/1989 | Gabrielidis | 42/72 |
| 4,934,246 | A | * | 6/1990 | Benson et al. | 89/36.14 |
| 4,978,206 | A | * | 12/1990 | Neuman et al. | 359/405 |
| 5,022,723 | A | * | 6/1991 | Schmidt et al. | 359/355 |
| 5,033,219 | A | | 7/1991 | Johnson et al. | 42/103 |
| 5,213,335 | A | * | 5/1993 | Dote et al. | 463/51 |
| 5,434,704 | A | * | 7/1995 | Connors et al. | 359/403 |
| 5,528,418 | A | | 6/1996 | Bowman, Jr. | 359/400 |
| 5,577,326 | A | | 11/1996 | Montelin | 33/241 |
| 5,671,561 | A | | 9/1997 | Johnson et al. | 42/103 |
| 5,793,528 | A | | 8/1998 | Wallace et al. | 359/419 |
| D398,035 | S | | 9/1998 | Rowe | D22/103 |
| 5,902,996 | A | | 5/1999 | Sauter | 250/214 |
| 6,061,945 | A | | 5/2000 | Wallace et al. | 42/101 |
| 6,154,313 | A | | 11/2000 | Isbell et al. | 359/419 |
| 6,169,628 | B1 | | 1/2001 | Isbell et al. | 359/399 |
| 6,487,809 | B1 | * | 12/2002 | Gaber | 42/119 |

FOREIGN PATENT DOCUMENTS

| | | | | |
|---|---|---|---|---|
| DE | 3536543 | | 4/1987 | |
| GB | 2272146 | A * | 5/1994 | A42B/1/24 |

* cited by examiner

*Primary Examiner*—Michael J. Carone
*Assistant Examiner*—D Buckley
(74) *Attorney, Agent, or Firm*—Hall, Priddy, Myers & Vande Sande

(57) ABSTRACT

Aiming apparatus rotatably attachable to optical sights e.g. conventional optical or laser sights which selectively permits the aiming of a weapon from a variety of cover positions. More specifically, aiming apparatus which may be field switched from an "aim from cover" mode to a conventional aim mode and which is connectable to a weapon sight in a 360 degree rotatable manner.

23 Claims, 4 Drawing Sheets

FIG. 6
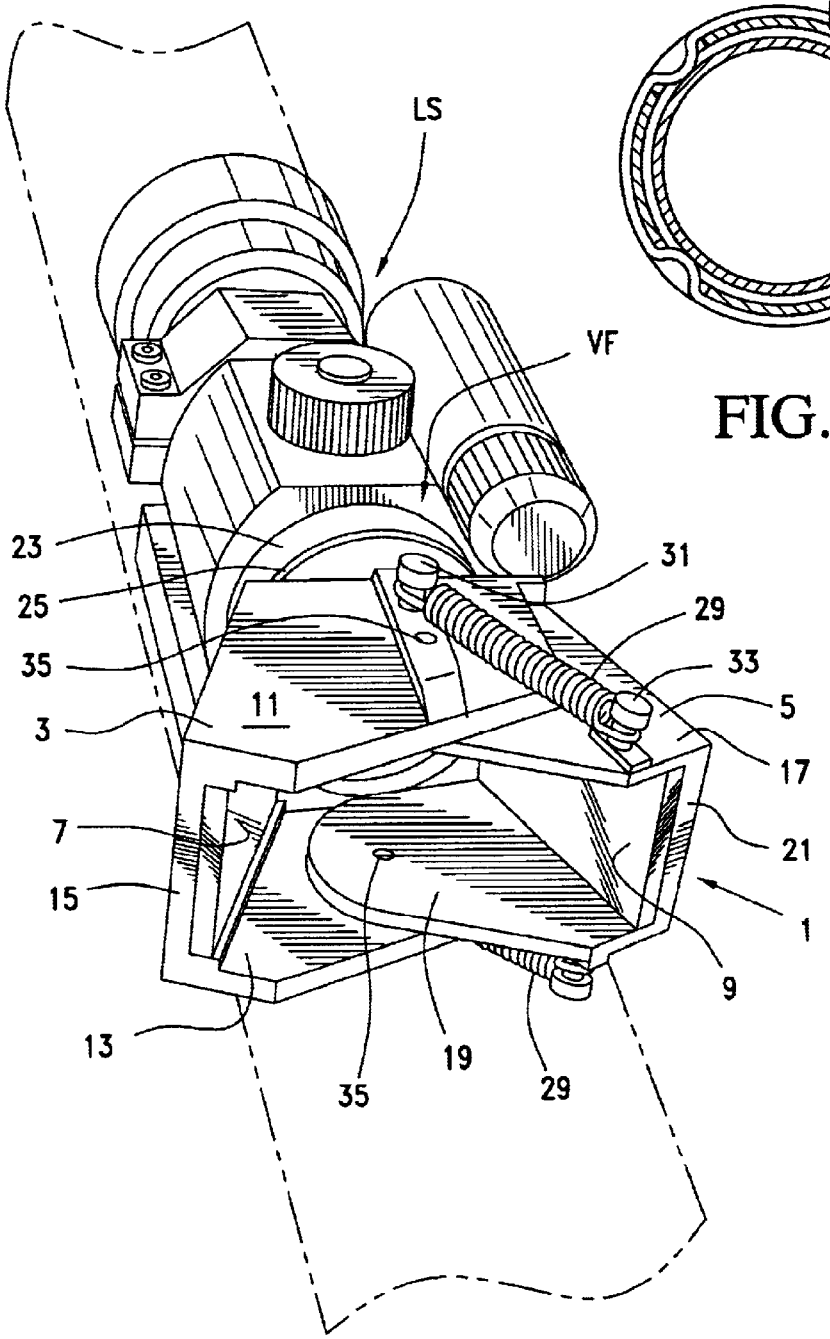
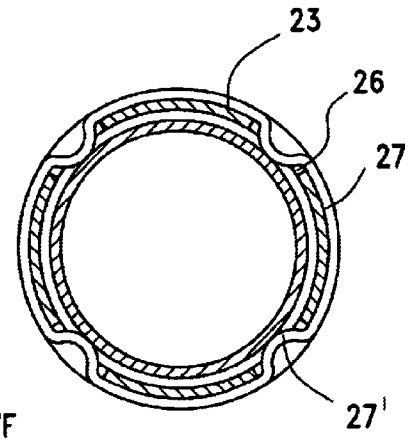
FIG. 7

OPTICAL SIGHT APPARATUS FOR FIRING FROM COVER POSITIONS

FIELD OF INVENTION

This invention relates to aiming apparatus attachable to optical sights e.g. conventional optical or laser sights which selectively permits the aiming of a weapon from a variety of cover positions. More particularly, this invention relates to aiming apparatus which may be field switched from an "aim from cover" mode to a conventional aim mode and which is connectable to a weapon sight in a 360 degree rotatable manner.

BACKGROUND OF INVENTION

Mirrored apparatus as well as other devices are known which are employable on a weapon (e.g. a rifle or a handgun) in order that the person utilizing the weapon be capable of aiming from a cover position e.g. out of line of enemy fire. Such known apparatus are typically mounted in the normal line of sight of the weapon and then project targeted images to a cover position therefrom. However, known devices are limited in the number of aim from cover positions which are obtainable, are bulky or simply ill suited for combat type use, or are dependent on a power supply. For example, U.S. Pat. No. 3,863,354 describes a dual mirror type reflective sight which is designed to provide an "aim from cover" position behind and below the position of the weapon. This allows a person to aim a weapon equipped with such a reflective sight from behind the cover of a wall for example. Although the specific "behind and below" position disclosed in the '354 patent is useful in some scenarios, many additional "aim from cover" positions (e.g. from a side of a weapon) are desirable and would prove useful for improving combat efficiency in the field.

Apparatus analogous to that disclosed in the '354 patent are disclosed in U.S. Pat. No. 4,878,305. This patent discloses a periscope type device which suffers deficiencies similar to that of the '354 device and, in addition, is too complex as well as too large and/or heavy for practical use in the field.

Still further attempts to solve the needs of the art have included the use of weapon mounted video cameras aimed down the barrel of a weapon combined with portable miniature video monitors (e.g. heads up displays) for displaying the video capture i.e. target. Although such video sights are highly effective in that targeted views may be accessed from virtually any cover position, such video sights require power supplies which become depleted, are vulnerable to field conditions, and are expensive compared to mechanical devices.

In view of the foregoing, it is apparent that there exists a need in the art for aiming apparatus which overcomes, mitigates, or solves the above problems in the art. It is a purpose of this invention to fulfill this and other needs in the art which will become more apparent to the skilled artisan once given the following closure.

SUMMARY OF THE INVENTION

Generally speaking, this invention fulfills the above-described needs in the art by providing: aiming apparatus comprising:

means for rotatably connecting the aiming apparatus to a weapon sight;

a first aperture located along a first axis for transmission of light images therethrough;

first body having a first reflective surface;

a second body having a second reflective surface; the second body being pivotally moveable with respect to the first body between a first and a second position;

wherein when the second body is oriented in the first position, light images which enter the aiming apparatus from a weapon sight enter through the first aperture along the first axis and exit through a second aperture located along the first axis; and wherein when the second body is oriented in the second position, light images which enter the aiming apparatus from a weapon sight enter through the first aperture along the first axis and are reflected by the second reflective surface to the first reflective surface whereby the first reflective surface reflects the light images such that the light images exit the aiming apparatus through a third aperture located along a second axis.

In another embodiment, there is provided: aiming apparatus comprising:

means for rotatably attaching the aiming apparatus to a weapon sight;

a sight body including an image directing means, the sight body having a first aperture located along a first axis for entry of light images therethrough, and the sight body including a second aperture located along a second axis for exit of light images therethrough;

wherein the image directing means is so located such that light images which enter the sight body through the first aperture enter at a first angle and impinge upon the image directing means and thereafter exit the sight body through the second aperture at a second angle different from the first angle.

This invention will now be described with respect to certain embodiments thereof as illustrated in the following drawings wherein:

BRIEF DESCRIPTION OF THE DRAWINGS

FIG. 6 is a three-dimensional end view of the embodiment according to FIG. 4.

FIG. 7 is an end-plan view of the unique sight adaptor attaching mechanism according to the subject invention illustrated connected to a laser sight.

DETAILED DESCRIPTION OF CERTAIN EMBODIMENTS

Figure 1:
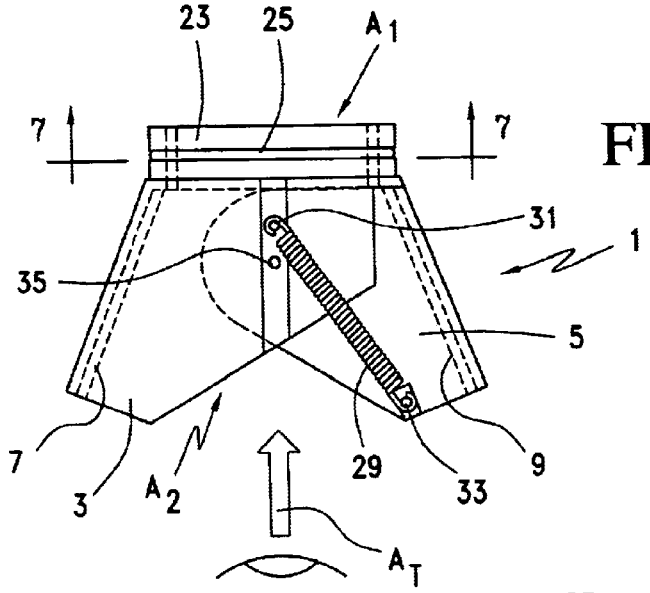
FIG. 1 is a side-plan view of one embodiment of the sight adaptor according to the subject invention illustrated with the reflector body in the conventional aiming position.

Referring initially to FIG. 1, therein is illustrated one embodiment of the sight adaptor according to the subject invention which overcomes the above described problems in the art. As illustrated, sight adaptor 1 generally comprises first reflector body 3, second reflector body 5, and a connecting mechanism i.e. tubular body 23 for connecting sight adaptor 1 to a weapon sight. As may be seen in FIG. 6, each reflector body is comprised of a pair of side walls 11, 13 and 17, 19 and end walls 15 and 21 respectively. Other embodiments employing different structures are, of course, contemplated. Aiding in the functionality of the subject invention, each end wall 15 and 21 of the reflector bodies includes, attached or integral thereto, a reflecting surface for selectively reflecting images to a variety of sighting positions (e.g. cover positions) when desired e.g. by placing reflector body 5 in the "fire from cover" position as described in detail below. In this embodiment, the reflecting surfaces are comprised of mirrors 7 and 9 attached to walls 15 and 21, however, any material which has sufficient reflective properties may be alternately employed.

Figure 2:
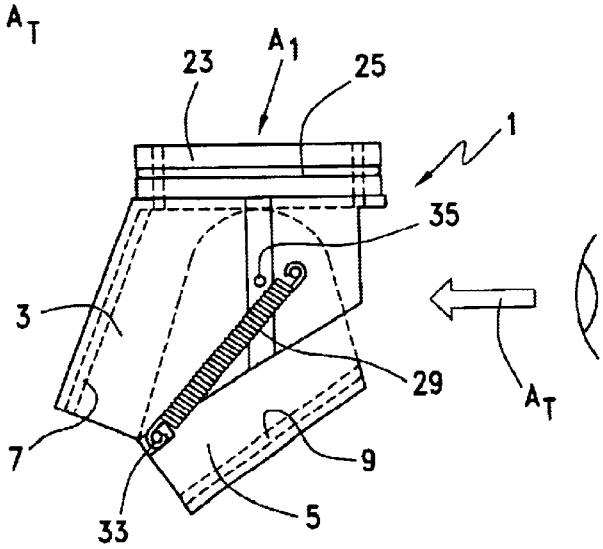
FIG. 2 is a side-plan view of the embodiment of the sight adaptor according to the subject invention illustrated with the reflector body in the "aim from cover" position.
Figure 3:
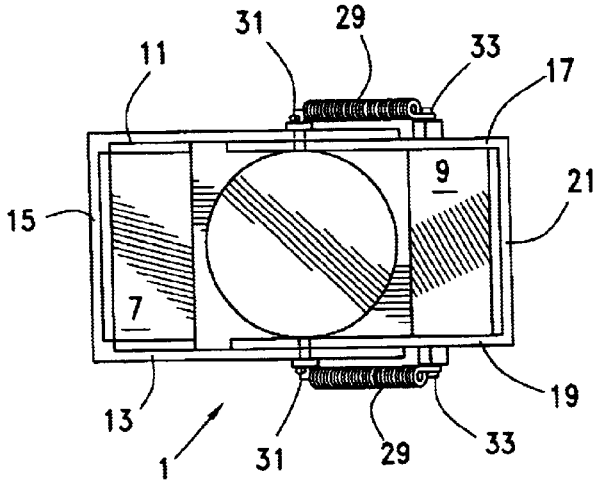
FIG. 3 is an end-plan view of the embodiment of FIG. 1 illustrating the line of sight in the conventional aiming position.
Figure 4:
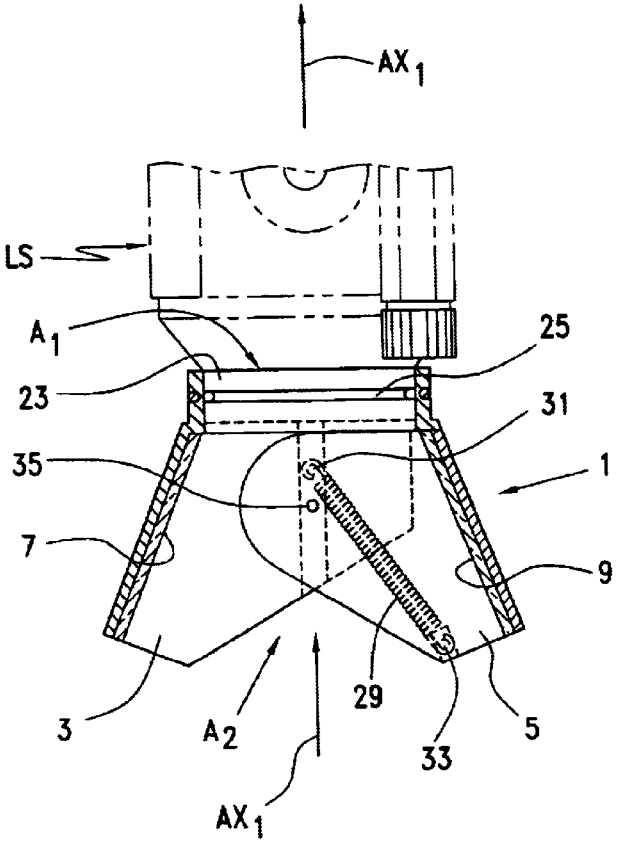
FIG. 4 is a side-plan view of the embodiment of FIG. 1 illustrated attached to a conventional laser sight.
Figure 5:
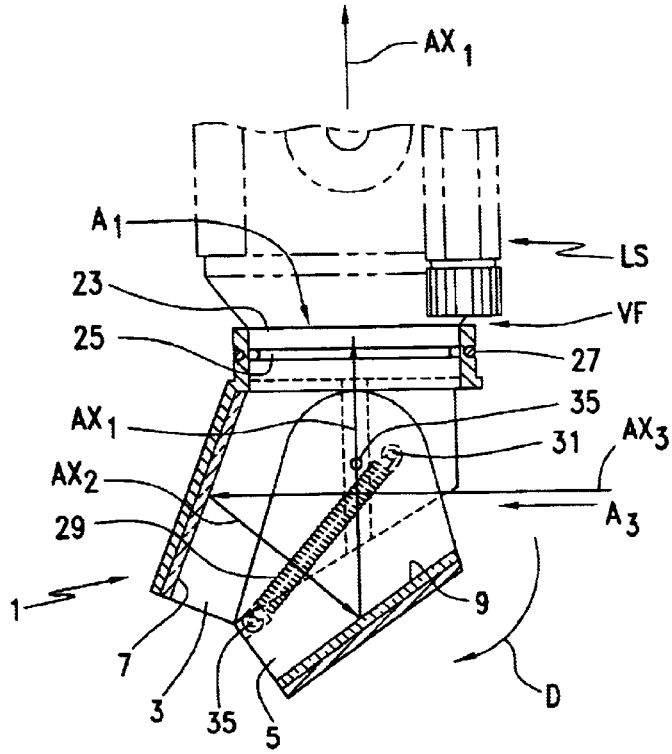
FIG. 5 is a side-plan view of the embodiment of FIG. 2 illustrated attached to a conventional laser sight.

In order to provide the ability to selectively view a targeted image from both a cover position and from a conventional fire position, reflective body 5 is pivotable with respect to reflective body 3 and, as such, is movable between at least two sighting positions. These positions are 1) the "open" position for normal aiming i.e. sighting down the bore of the weapon, and 2) the "closed" or "fire from cover" position for aiming from positions off-line from the axis of the bore of the weapon e.g. from behind a wall or around a corner. Position 1 is illustrated in FIGS. 1 and 4 and position 2 is illustrated in FIGS. 2 and 5 (the directions of the arrows "$A_T$" indicate the direction in which target images are viewed). In order to achieve this pivotability, reflector bodies 3 and 5 are connected via pivot pins 35 at an intersection between their side walls i.e. between walls 11 and 17 and between walls 13 and 19 respectively. Thus, although reflector body 3 is fixed immovably to tubular body 23 (i.e. the sight connecting mechanism), reflector body 5, via its pivotable engagement with reflective body 3 (and because it is not attached to tubular body 23) is able to be selectively "flipped" back and forth between the positions 1 and 2 described above. These positions, of course, provide the various aiming positions discussed above (and as will be described in more detail below).

In order to retain reflective body 5 selectively as desired in the two aiming positions, springs 29 are provided attached on either side of the sight adaptor device extending between spring attachment pins 31 and 33 (on reflector bodies 3 and 5 respectively) so that reflector body 5 is retained in position 1 or 2 as chosen. This position retaining feature is accomplished, in this regard, employing the elastic force of the spring in combination with the mounting position of the ends of spring 29 (at pins 31 and 33) with respect to the position of pivot pins 35. Thus, when reflector body is in either position 1 or 2, the elastic force of springs 29 holds reflector body 5 in place until the position is desired to be changed.

Referring now again to FIG. 4, the "open" position of sight adaptor 1 is illustrated in more detail therein. As may be seen in the figure, in this open position, mirrors 7 and 9 are each located in a plane which does not intercept the axis $AX_1$, of the "normal" line of sight down the bore of a weapon (e.g. the direct line of sight extending through viewfinder VF of laser sight LS [see FIG. 6 and FIG. 8]). Thus, light images which enter sight adaptor 1 (e.g. when it is attached to laser sight "LS") are not deflected by either of mirrors 7 or 9. Instead, light images, when sight adaptor 1 is in the "open" position, enter first aperture $A_1$ along axis $AX_1$, and exit through second aperture $A_2$ along the same axis. Therefore, when reflector body 5 is oriented in the "open" position, a user of the weapon employing sight adaptor 1 can aim the weapon in a conventional manner by simply sighting through aperture $A_2$ (thus obtaining a view similar to that which would be seen if sight adaptor 1 were not in place). This position is useful when a cover position is not desired.

In certain circumstances, a conventional firing position is dangerous and exposes the weapon user to enemy fire. In such circumstances, the ability to aim from a "cover position" may be desired, and for this purpose, reflective body 5 may be changed from its "open" position to the "closed" or "fire from cover" position illustrated in detail in FIG. 5. This "closed" position is achievable in this embodiment by simply pushing or "flipping" reflective body 5 (from its "open" position illustrated in FIGS. 1 and 4) towards reflective body 3 and about pivot pin 35 in a direction as indicated by the directional arrow "D" in this figure. When reflective body 5 is in the illustrated "closed" position, mirror 9 is now positioned in the path of axis $AX_1$, and light images which enter through first aperture $A_1$ are now intercepted by mirror 9. Thus, in this "closed" position, when light images enter sight adaptor 1 through aperture $A_1$, they impinge on mirror 9 from where they are reflected to mirror 7 and thereafter out of sight adaptor 1 through aperture $A_3$ (along axis $AX_3$). An exemplar light path for this "closed" position is illustrated in FIG. 2 and may be traced therein by following the sequence of axis arrows $AX_1$–$AX_3$. As may be seen by tracing these arrows, light images which now enter sight adaptor 1 (parallel to axis $AX_1$,) are now projected (out of aperture $A_3$) at an angle which is approximately 90 degrees from their original angle of entry. These images, then, (and thus the target view) may therefore be viewed from a position where a user can aim the weapon while still shielding his/her body in a cover position (e.g. behind a wall, around a corner, from a trench). It is noted, in this regard, that although a viewing angle of approximately 90 degrees (from axis $AX_1$) is shown, many other angles may be employed as desired by simple adjustments to the placement and angles of mirrors 7 and 9 described herein (an exemplar range of angles being approximately 60–120 degrees).

Figure 8:
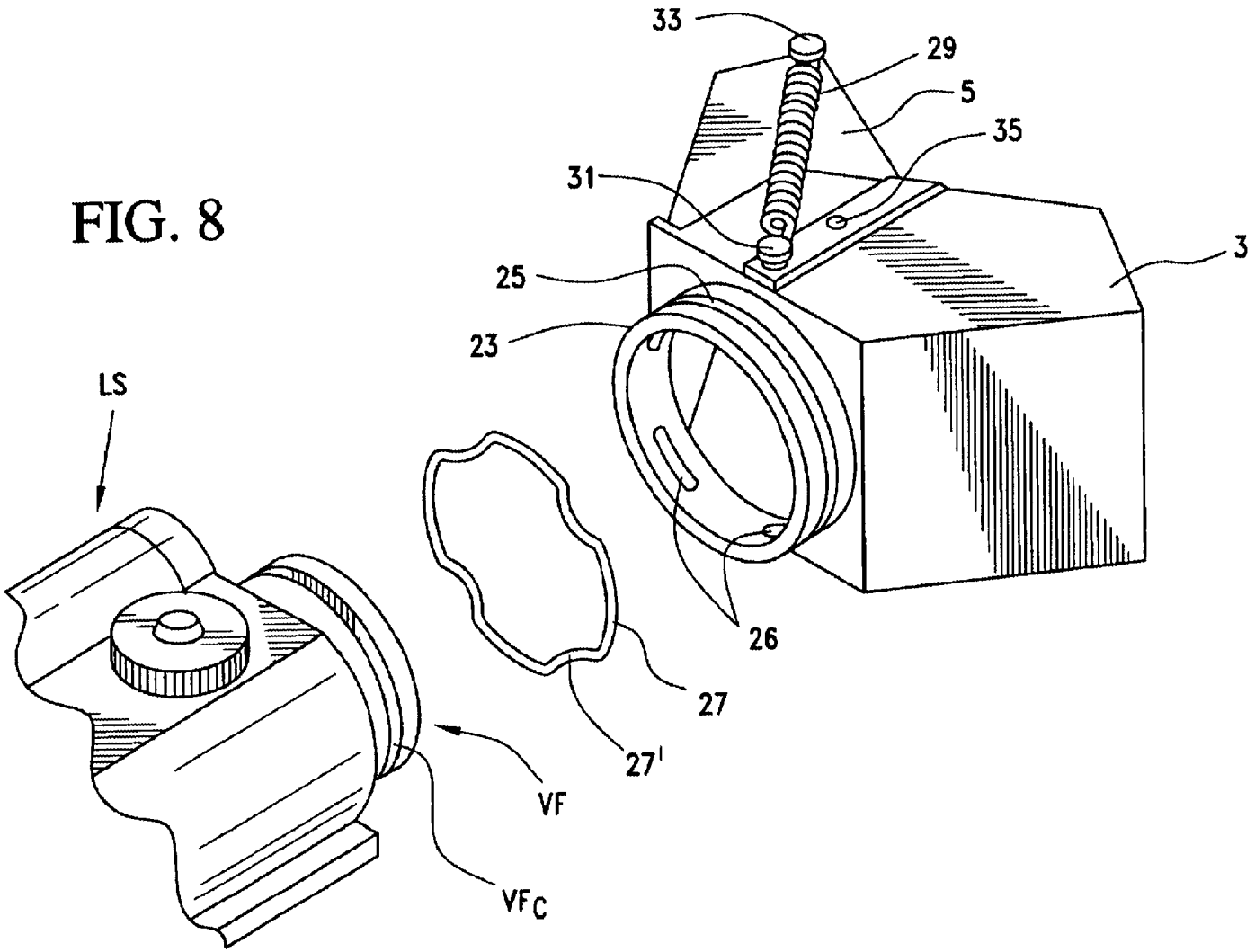
FIG. 8 is a three-dimensional, partially blown-apart view of the sight adaptor attaching mechanism according to the subject invention shown disconnected from a laser sight.

Referring now to FIGS. 7 and 8, a detailed view of the mechanism for attaching sight adaptor 1 to laser sight LS (or other type e.g. an optical scope) is illustrated therein. As will become clear from the structural description which follows, the unique connecting mechanism employed by the invention herein enables a user (e.g. a soldier or a police officer) to aim his/her weapon from an infinite number of angles above, below, or on either side of the weapon. This functionality is made possible due, in particular, to the rotatable sight adaptor mounting mechanism illustrated in these figures. Specifically, the rotatable sight adaptor connecting mechanism illustrated therein comprises a tubular body 23 having a channel 25 extending around its circumference. Located within channel 25 are various spaced apart perforations 26. Channel 25, in combination with perforations 26, is provided so that fastening ring 27 may be seated integral thereto (see FIG. 7). As may be seen in FIG. 8, fastening ring 27 is generally circular in shape but includes a plurality of indentations 27' around its circumference such that when fastening ring 27 is installed in channel 25, indentations 27' nest in perforations 26 and extend slightly into the inner circumference of tubular body 23.

Referring still to FIG. 8, it may be seen that conventional laser sight LS includes an annular viewfinder VF through which targets are normally sighted (e.g. when sight adaptor 1 is not employed). Included on the circumference of this viewfinder is an annular channel $VF_C$ via which the unique rotatable mounting of sight adaptor 1 is accomplished. In particular, sight adaptor 1 can be attached to laser sight LS using a simple snap on type motion by first orienting tubular body 23 such that it is in alignment with annular viewfinder VF. Once aligned, sight adaptor 1 is moved so that tubular body 23 is placed over the annular body of viewfinder VF and such that the portions of indentations 27' which extend through perforations 26 snap into place in channel $VF_C$. Once indentations 27' have seated in place as such, sight adaptor 1 is secured to laser sight LS albeit in a unique 360 degree rotatable fashion. It is this rotatable feature which provides a user with the advantageous ability to rotate sight adaptor 1 to different viewing positions as needed and thus view a target from virtually any cover position e.g. above, below, or from either side of the weapon via the reflection and thus redirection of the light image by mirrors 7 and 9. Employing such an embodiment, then, a weapon user is no longer limited to the view which has been provided by the fixed mounting position of a mirrored sight such as is disclosed in U.S. Pat. 3,863,354. It is noted, in this regard, that this rotatable attachment feature is believed to be patentable alone and thus may be employed, as a patentable combination, even with a sight adaptor not employing the two position (i.e. open and closed) feature. Such a weapon sight adaptor simply provides a "view from cover" view without providing the ability to switch to a conventional fire position.

In certain exemplar embodiments, fastening ring 27 is installed such that indentations 27', when sight adaptor 1 is attached to laser sight LS, bear against a surface of channel $VF_C$ such that rotation of sight adaptor 1 about its connection with laser sight LS only occurs when a force above a threshold value is applied. In this regard, then, accidental rotation of sight adaptor 1 from a particular viewing position is minimized.

Once given the above disclosure, many other features, modifications, and improvements will become apparent to the skilled artisan. Such other features, modifications, and improvements are therefore considered to be a part of this invention, the scope of which is to be determined by the following claims.

I claim:

1. Aiming apparatus comprising:

means for rotatably connecting said aiming apparatus to a weapon sight;

a first aperture located along a first axis for transmission of light images therethrough;

a first body having a first reflective surface;

a second body having a second reflective surface; said second body being pivotally moveable with respect to said first body between a first and a second position;

wherein when said second body is oriented in said first position, light images which enter said aiming apparatus from a weapon sight enter through said first aperture along said first axis and exit through a second aperture located along said first axis; and wherein when said second body is oriented in said second position, light images which enter said aiming apparatus from a weapon sight enter through said first aperture along said first axis and are reflected by said second reflective surface to said first reflective surface whereby said first reflective surface reflects the light images such that the light images exit said aiming apparatus through a third aperture located along a second axis.

2. The aiming apparatus according to claim 1 wherein said means for rotatably connecting said aiming apparatus permits said aiming apparatus to be rotatable about said first axis substantially 360 degrees.

3. The aiming apparatus according to claim 2 wherein said means for rotatably connecting said aiming apparatus comprises a tubular body for rotatably connecting with a substantially annular surface of a view finder of a weapon sight.

4. The aiming apparatus according to claim 3 wherein said tubular body includes an annular channel having perforations located therein and a fastening ring for seating within said annular channel.

5. The aiming apparatus according to claim 4 wherein said fastening ring includes a plurality of indentations forming protrusions for nesting within said perforations and wherein when said aiming apparatus is attached to a weapon sight, said protrusions bias against a surface of the weapon sight thereby to restrict rotation of said aiming apparatus about said first axis.

6. The aiming apparatus according to claim 1 wherein said second axis is oriented substantially 60–120 degrees with respect to said first axis.

7. The aiming apparatus according to claim 6 wherein said first and said second reflective surfaces comprise mirrors.

8. The aiming apparatus according to claim 7 further including a retaining means for retaining said second body in said first or said second position.

9. The aiming apparatus according to claim 8 wherein said retaining means comprises a first mounting pin located proximal said first body, a second mounting pin located proximal said second body, and a coil spring extending between said first and said second mounting pins.

10. The aiming apparatus according to claim 9 wherein said second axis is oriented substantially 70–110 degrees with respect to said first axis.

11. The aiming apparatus according to claim 10 wherein said second axis is oriented substantially 80–100 degrees with respect to said first axis.

12. Aiming apparatus comprising:

means for rotatably attaching said aiming apparatus to a weapon sight such that said aiming apparatus is continuously rotatable;

a sight body including an image directing means, said sight body having a first aperture located along a first axis for entry of light images therethrough, and said sight body including a second aperture located along a second axis for exit of light images therethrough;

wherein said image directing means is so located such that light images which enter said sight body through said first aperture enter at a first angle and impinge upon said image directing means and thereafter exit said sight body through said second aperture at a second angle different from said first angle.

13. Aiming apparatus comprising:

means for rotatably attaching said aiming apparatus to a weapon sight such that said aiming apparatus is continuously rotatable;

a sight body including an image directing means, said sight body having a first aperture located along a first axis for entry of light images therethrough, and said sight body including a second aperture located along a second axis for exit of light images therethrough;

wherein said image directing means is so located such that light images which enter said sight body through said first aperture enter at a first angle and impinge upon said image directing means and thereafter exit said sight body through said second aperture at a second angle different from said first angle; and wherein said means for rotatably attaching said aiming apparatus permits said aiming apparatus to be rotatable about said first axis substantially 360 degrees.

14. The aiming apparatus according to claim 13 wherein said means for rotatably attaching said aiming apparatus comprises a tubular body for rotatably connecting with a substantially annular surface of a view finder of a weapon sight.

15. The aiming apparatus according to claim 14 wherein said tubular body includes an annular channel having perforations located therein and a fastening ring for seating within said annular channel.

16. The aiming apparatus according to claim 15 wherein said fastening ring includes a plurality of indentations forming protrusions for nesting within said perforations and wherein when said aiming apparatus is attached to a weapon sight, said protrusions bias against a surface of the weapon sight thereby to restrict rotation of said aiming apparatus about said first axis.

17. The aiming apparatus according to claim 14 wherein said image directing means comprises a prism.

18. The aiming apparatus according to claim 14 wherein said image directing means comprises a mirror attached at an angle with respect to said first axis.

19. The aiming apparatus according to claim 14 wherein said second axis is oriented substantially 60–120 degrees with respect to said first axis.

20. The aiming apparatus according to claim 14 wherein said second axis is oriented substantially 70–110 degrees with respect to said first axis.

21. The aiming apparatus according to claim 14 wherein said second axis is oriented substantially 80–100 degrees with respect to said first axis.

22. Aiming apparatus comprising:

means for rotatably attaching said aiming apparatus to a weapon sight such that said aiming apparatus is continuously rotatable;

a sight body including an image directing means, said sight body having a first aperture located along a first axis for entry of light images therethrough, and said sight body including a second aperture located along a second axis for exit of light images therethrough;

wherein said image directing means is so located such that light images which enter said sight body through said first aperture enter at a first angle and impinge upon said image directing means and thereafter exit said sight body through said second aperture at a second angle different from said first angle; and wherein said second angle is oriented approximately 40–90 degrees from said first angle.

23. The aiming apparatus according to claim 22 wherein said means for rotatably connecting said aiming apparatus permits said aiming apparatus to be rotatable about said first axis substantially 180 degrees.

* * * * *

UNITED STATES PATENT AND TRADEMARK OFFICE

CERTIFICATE OF CORRECTION

PATENT NO. : 6,643,969 B1
DATED : November 11, 2003
INVENTOR(S) : Avizonis, Jr.

It is certified that error appears in the above-identified patent and that said Letters Patent is hereby corrected as shown below:

Title page,
Item [75], delete "Inventor:", and insert -- Inventors: --; and insert -- Todd David Carey, San Diego, CA (US) --.

Signed and Sealed this

Fourth Day of May, 2004

JON W. DUDAS
*Acting Director of the United States Patent and Trademark Office*